United States Patent [19]

Wood

[11] Patent Number: 4,902,208

[45] Date of Patent: Feb. 20, 1990

[54] PUMP HAVING PISTON AND CYLINDER ROTATABLE RESPECTIVELY ABOUT SPACED AXES TRANSVERSE TO THE RECIPROCATING AXIS

[76] Inventor: R. A. Ray Wood, 3396 Marine Dr., West Vancouver, B.C., Canada, V7V 1M9

[21] Appl. No.: 713,563

[22] Filed: Mar. 18, 1985

Related U.S. Application Data

[63] Continuation of Ser. No. 534,776, Sep. 22, 1983, abandoned.

[51] Int. Cl.[4] ..... F04B 19/02

[52] U.S. Cl. ..... 417/462; 417/466

[58] Field of Search ..... 417/462, 463, 466, 250, 417/503, 500; 123/450; 91/196

[56] References Cited

U.S. PATENT DOCUMENTS

| | | | |
|---|---|---|---|
| 1,671,565 | 5/1928 | Astrom | 417/462 |
| 2,411,929 | 12/1946 | Malke | 417/462 |
| 2,510,903 | 6/1950 | Quiroz | 417/462 |
| 4,393,844 | 7/1983 | Skinner | 123/450 |

*Primary Examiner*—Leonard E. Smith

*Attorney, Agent, or Firm*—Reising, Ethington, Barnard, Perry & Milton

[57] ABSTRACT

A pump assembly (10) including a piston (12) connected to a rotating wheel (30) by a pin (32) radially offset from the axis of rotation of the wheel and a cylinder (14) in reciprocating telescoping relationship with the piston (12) and supported by a hollow shaft (26) for rotation in a housing member (24) so that the piston (12) rotates about the axis of a supporting shaft (22) extending transversely to the reciprocating movement while the cylinder (14) rotates about another axis transverse to the reciprocating movement with the distance between the two axes being adjustable to vary the displacement of the pumping chamber (16) between zero when the two axes coincide to a maximum degree when the two axes are spaced the maximum amount. The housing (24) rotatably supporting the hollow shaft (26) of the cylinder (14) includes two fixed fluid ports (50, 52) which alternately communicate with an axially aligned radial port (48) in the hollow shaft (26).

14 Claims, 2 Drawing Sheets

PUMP HAVING PISTON AND CYLINDER ROTATABLE RESPECTIVELY ABOUT SPACED AXES TRANSVERSE TO THE RECIPROCATING AXIS

This application is a continuation, of application Ser. No. 534,776, filed 9/22/83, now abandoned.

TECHNICAL FIELD

The subject invention relates to a pumping assembly of the type including a piston member reciprocally disposed within a cylinder for pumping action upon relative reciprocating motion between the members. Such assemblies include a mechanism for effecting the reciprocating motion between the piston and cylinder members and a valving arrangement for controlling the fluid flow to and from the pumping chamber.

BACKGROUND ART

Although the subject invention may have other uses, it is particularly suitable for use in a marine steering system. A marine steering system in a boat typically includes a double-acting steering cylinder connected to the rudder of the boat and supplied hydraulic fluid through two lines connected to opposite ends of the cylinder and extending to a manually operated steering pump typically connected to a steering wheel which is manually rotated in opposite steering directions.

Such steering systems frequently also include an automatic pilot which detects the course of the marine vessel and makes course corrections by feeding signals to drive an auxiliary hydraulic fluid pump which is also connected to the hydraulic steering cylnder. The auxiliary pumps typically used in such systems have low volumetric efficiency, high internal slippage, and require check valves to isolate the pump from the remainder of the manually actuated steering assembly.

SUMMARY OF INVENTION AND ADVANTAGES

A pump assembly comprising piston and cylinder pumping members in telescoping relationship with one another for reciprocating movement relative to one another along a reciprocating axis to define a pumping chamber therebetween. A piston support means supports the piston member for rotation about a first axis extending transversely to the reciprocating axis. In a similar fashion, a cylinder support means supports the cylinder member for rotation about a second axis extending transversely to the reciprocating axis so that the piston member rotates about the first axis in conjunction with the cylinder member rotating about the second axis. The assembly is characterized by the cylinder member being open except for the piston member to establish only one pumping chamber between the members and including commutating valve means for establishing fluid flow into the single pumping chamber during one portion of each revolution to charge the pumping chamber and for establishing fluid flow from the pumping chamber during the remainder of each revolution. The assembly is also characterized by a fluid passage extending from the pumping chamber to a radial port rotatable about one of the first and second axes with first and second fixed ports non-rotatable about that axis and spaced circumferentially from one another and axially aligned with the radial port for alternatively communicating with the radial port so the fluid flows in one direction through the fixed ports upon rotation of the piston and cylinder members about their axes in one direction and flows in the opposite direction through the fixed ports upon the opposite direction of rotation.

Such a pump assembly provides very high efficiency which converts to minimum power requirements for driving the pump assembly. The pump assembly also has very low internal leakage and, therefore, eliminates the requirement for check valves to prevent fluid flow through the pump assembly when at rest. The pump assembly of the subject invention, because it is single acting, i.e., a single pumping chamber, can only rotate a maximum of onehalf a revolution when pressure is at rest and pressure is fed into an outlet port and therefore further eliminates the requirement for check valves to prevent fluid flow through the assembly when at rest.

PRIOR ART STATEMENT

Pumping assemblies constructed in accordance with the subject invention are not known in the prior art. There are, however, mechanisms of similar structure but which are utilized as engines, such as steam engines. Such are considered illustrated in the U.S. Pat. Nos. 582,257 to Berry and 628,945 to Lawrence. In these assemblies the piston is double-acting and would be inoperative if the piston did not move an equal distance on opposite sides of the axis of rotation of the cylinder. In addition to not including the adjustable displacement of the subject invention, these prior art mechanisms do not include a commutating valve system which includes only one port for directing fluid to and from the pumping chamber which alternately communicates with stationary ports which may be connected to opposite ends of a marine steering considered assembly. Mechanisms having similar structure are known such as that in Robinson U.S. Pat. No. 683,987 which is, however, deficient because the porting arrangement provides for fluid flow always in the same direction regardless of rotation of the entire mechanism.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE INVENTION

Figure 1:
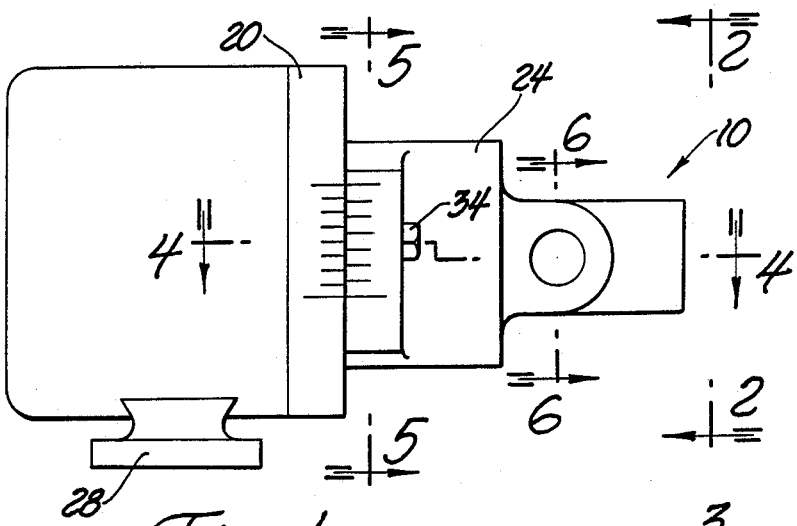
FIG. 1 is a side-elevational view of a preferred embodiment of the subject invention.
Figure 2:
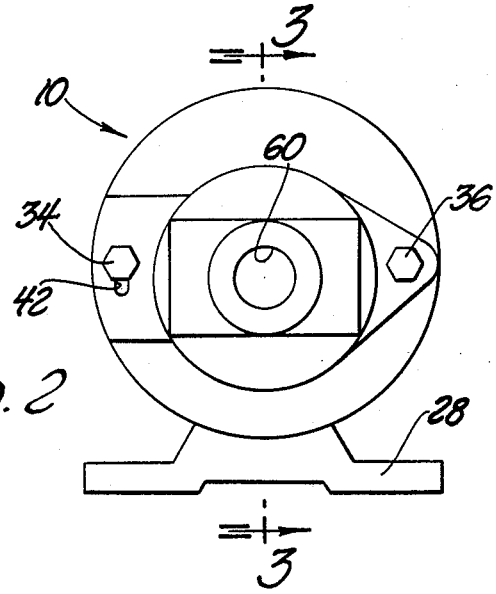
FIG. 2 is an end view taken substantially along along line 2—2 of FIG. 1.

A pump assembly constructed in accordance with the subject invention is generally shown at 10.

The pump assembly 10 includes piston and cylinder pumping members 12 and 14. The pumping members 12 and 14 are in telescoping relationship with one another for reciprocating movement relative to one another along a reciprocating axis to define a pumping chamber 16 therebetween. The piston 12 is in sliding engagement with the interior of the cylinder member 14 and a fluid seal 18 prevents fluid leakage therebetween. The cylinder member 14 is open except for the piston 12 to define or establish only one pumping chamber 16 between the members 12 and 14 so that the piston member 12 is single acting.

A piston support means including a first housing member 20 and a shaft 22 rotatably supported therein, supports the piston member 12 for rotation about a first axis defined by the shaft 22. The axis of the drive shaft 22 extends transversely or, more specifically, perpendicular to the reciprocating axis of the piston 12 within the cylinder 14.

A cylinder support means including a second housing member 24 rotatably supports the support shaft 26 formed integral with and forming a part of the cylinder member 14. By rotatably supporting the support shaft 26, the second housing member 24 rotatably supports the cylinder member 14 for rotation about a second axis defined by the axis of the support shaft 26. The axis of the support shaft 26 extends transversely and, more specifically, perpendicular to the reciprocating axis of the piston 12 within the cylinder 14. The piston member 12 rotates about the first axis of the shaft 22 in conjunction with the cylinder member 14 rotating about the second axis of the support shaft 26.

The first housing 20 supports a drive means comprising an electric motor, or the like, which rotates the drive shaft 22. The housing member 20 includes a pedestal 28 upon which the entire assembly is supported.

A circular wheel or disc 30 is attached to the drive shaft 22 for rotation about the axis of the drive shaft 22. A pin 32 interconnects the wheel 30 and the piston member 12 on a swinging axis radially spaced from the axis of the drive shaft 22. In other words, the pin 32 is either fixedly secured to the wheel 30 to rotatably support the piston 12 about the axis of the pin 32 or the pin 32 is fixed to the piston 12 and the pin 32 is rotatable in its bore in the wheel 30. Appropriate key locks or rings prevent axial movement of the pin 32. The longitudinal axis of the piston 12 may swing about the swinging axis of the pin 32. The swinging axis of the pin 32, as well as the first axis of the drive shaft 22 and the second axis of the support shaft 26 are all parallel to one another.

The cylinder 14 is defined by an annular disc-like member. Both the wheel 30 and the cylinder member 14 are diametrically balanced on opposite sides of their respective axes of rotation to counterbalance centrifugal forces, i.e., they are balanced about their respective axes of rotation.

Figure 5:
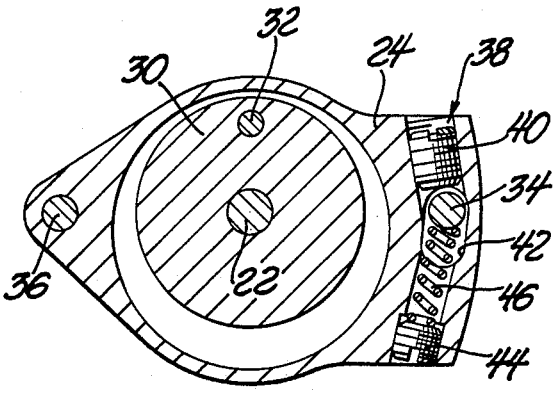
FIG. 5 is a cross-sectional view taken substantially along line 5—5 of FIG. 1.
Figure 6:
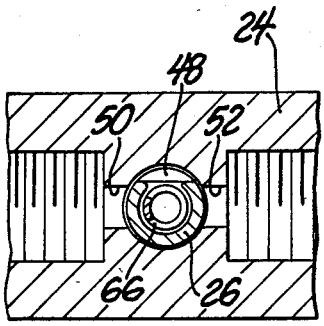
FIG. 6 is an enlarged fragmentary cross-sectional view taken substantially along line 6—6 of FIG. 1.

The assembly 10 includes an adjustment means comprising the bolts 34 and 36 and the elements generally indicated at 38 in FIG. 5. The adjustment means varies the distance between the first and second axes of the shafts 22 and 26, respectively, to adjust the length of the relative reciprocating movement between the piston and cylinder members 12 and 14. The bolt 36 defines a pivot connection between the housing members 20 and 24 for selectively allowing the housing members to pivot relative to one another about the pivot axis of the bolt 36 which is parallel to the first and second axes of the shafts 22 and 26, respectively, for adjusting the distance between the first and second axes of the shafts 22 and 26, respectively. The pivot axis defined by the bolt 36 is equally spaced from the first axis of the drive shaft 22 as it is from the second axis of the support shaft 26 whereby the second housing member 24 may be swung relative to the first housing member 20 about the pivot axis of the bolt 36 so that the axes of the drive shaft 22 and support shaft 26 may be moved toward and away from one another along the circumference of a circle having its center on the pivot axis of the pivot connection defined by the bolt 36. The bolt 34 defines a securing means connecting the housing members 20 and 24 together for preventing relative movement therebetween about the pivot axis defined by the bolt 36. Upon being loosened, the bolt 34 will also allow the housing 24 to be pivoted about the axis of the bolt 36 relative to the housing member 20 to change the position of the second axis of the support shaft 26 along the circumference of that circle relative to the position of the axis of the drive shaft 22 thereby to adjust the length of the relative reciprocating movement between the piston member 12 and the cylinder member 14. The bolts 34 and 36 are tightened to clamp the housing member together to prevent relative movement therebetween. In other words, the bolts 34 and 36, when tightened down, clamp the housing members 20 and 24 together and prevent relative movement therebetween. However, when loosened, the bolts 34 and 36 will allow the housing member 24 to be pivoted about the axis of the bolt 36 for adjusting the distance between the axes of the drive shaft 22 and the support shaft 26 to, in turn, adjust the displacement or the volume of the pumping chamber 16.

The securing means which includes the bolt 34 also includes a vernier positioning means for adjusting the distance between the axes of the drive shaft 22 and the support shaft 26. The vernier positioning means includes a threaded bore extending into the second housing member 24 with a threaded adjusting screw 40 disposed therein. The screw 40 abuts the side of the bolt 34 for reacting thereagainst. The housing member 24 includes an elongated slot 42 through which the bolt 34 extends. A biasing means comprising plug 44 and a spring 46 reacts between the housing 24 and the bolt 34 for urging the bolt 34 against the threaded adjusting screw 40. The housing member 24 may be swung about the pivot axis of the bolt 36 when the bolt 34 is loosened or allowed by the slot 42, and by the adjustment screw 40 which may be threaded into the threaded bore in the housing member 24.

Alternatively, a cam arrangement may be substituted for the adjustment screw 40 of the adjustment means 38. Further, two slots may surround both bolts 34 and 36 to shift the housing members relative to one another.

A vernier scale may be disposed on the two housing members 20 and 24 as shown in FIG. 1 to visually indicate the amount of displacement between the axes of the drive and support shafts 22 and 26.

The system also includes commutating valve means for delivering fluid to the pumping chamber 16 and for receiving fluid from the pumping chamber 16. The commutating valve means includes a passage extending from the pumping chamber 16 and through the support shaft 26 to a radial port 48 which is rotatable with the support shaft 26 about its axis. The housing member 24 includes first and second fixed or stationary ports 50 and 52 spaced circumferentially from one another or diametrically opposite one another on the axis of the support shaft 26. The ports 50 and 52 independently communicate with the radial port 48 during rotation of the support shaft 26 relative to the housing member 24. The ports 50 and 52 extend into threaded connections which may be utilized for hose or hydraulic lines leading to the hydraulic device actuated by the pump assembly. The stationary or fixed ports 50 and 52 are axially aligned relative to the support shaft 26 with the radial port 48 for alternately communicating with the radial port 48. Consequently, fluid will flow from the port 50 through the radial port 48 to the pumping chamber 16 and from the pumping chamber 16 back through the radial port 48 and out through the second port 52 upon rotation in one direction about the axes of the shafts 22 and 26, but will flow in the opposite direction from the fixed port 52 through the pumping chamber 16 and out the fixed port 50 when the rotation is in the opposite direction about the axes of the shafts 22 and 26.

Figure 7:
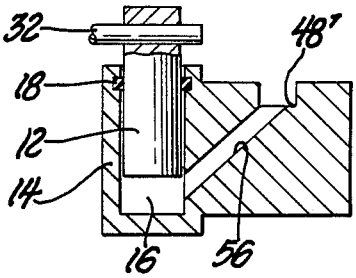
FIG. 7 is a fragmentary cross-sectional view showing an alternative fluid passage arrangement for communicating with the pumping chamber.
Figure 8:
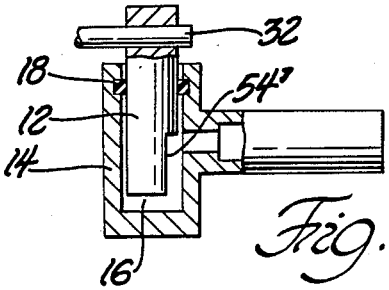
FIG. 8 is a fragmentary cross-sectional view similar to FIG. 7 but showing yet another embodiment of the fluid passage connection to the pumping chamber.

The fluid passage extending between the rotating radial port 48 and the pumping chamber 16 includes a passage 54 in the piston member 12 with a port in the cylinder member 14 on the axis of the supporting shaft 26. An alternative embodiment is shown in FIG. 7 wherein the fluid passage 56 communicates directly with the pumping chamber 16 and a port 48' which performs the same function as the radial port 48. In the embodiment illustrated in FIG. 8, instead of the passage 54 being internally of the piston member 12 as shown in FIG. 3, the passage 54' is disposed in the side of the piston 12.

Figure 3:
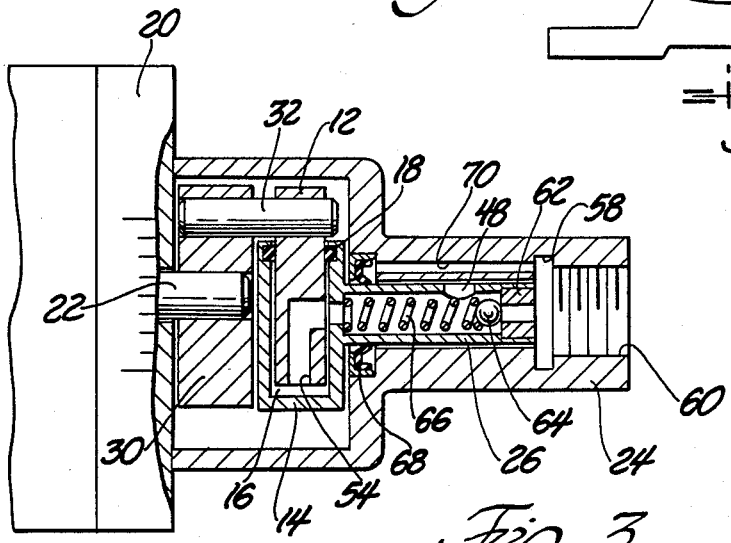
FIG. 3 is a fragmentary cross-sectional view taken substantially along line 3—3 of FIG. 2.
Figure 4:
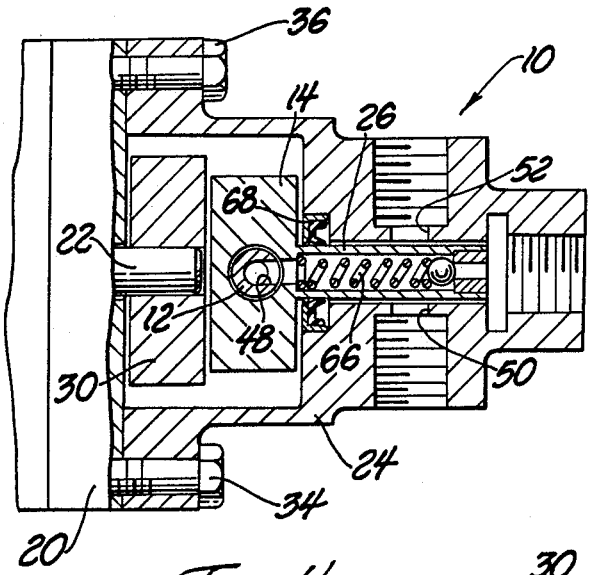
FIG. 4 is a fragmentary cross-sectional view taken substantially along line 4—4 of FIG. 1.

As shown in FIG. 3, the housing member 24 includes an annular cavity 58 disposed at the distal end of the support shaft 26 for fluid communication through a fluid line connected in the threaded bore 60 and leading to a reservoir. A check valve assembly including the seat 62 and ball 64 is disposed at the end of the support shaft 26 for establishing fluid communication between the cavity 58 and the fluid passage interiorly of the support shaft 26 to replenish fluid from the reservoir to the pumping chamber 16 when needed. A spring 66 is disposed within the support shaft 26 to urge the ball 64 against the seat 62 which is fixedly secured to the support shaft 26.

A seal assembly 68 affects a fluid seal between the housing member 24 and the support shaft 26. A fluid passage 70 relieves pressure buildup behind the seal 68 to the cavity 58 which is connected to the reservoir through the adjacent connection 60.

As will be appreciated, various of the components or subassemblies may be reversed as, for example, the cylinder may be attached to the drive shaft 22 with the piston attached to a commutating valve shaft supported in the opposite housing. It follows, therefore, that the commutating valve and fluid passageway may extend out through the piston instead of being associated with the cylinder.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A pump assembly (10) comprising; piston and cylinder pumping members (12, 14) in telescoping relationship with one another for reciprocating movement relative to one another along a reciprocating axis to define a single pumping chamber (16) therebetween, piston support means (20, 22, 30, 32) supporting said piston member (12) for rotation about a first axis extending transversely to said reciprocating axis, cylinder support means (24) supporting said cylinder member (14) for rotation about a second axis extending transversely to said reciprocating axis so that said piston member (12) rotates about said first axis in conjunction with said cylinder member (14) rotating about said second axis, said cylinder member (14) being open to receive and enclose said piston member (12) to establish one pumping chamber (16) between said piston and cylinder members (12, 14), said cylinder member (14) closing said pumping chamber (16) at all positions of relative reciprocation and of rotation of said piston and cylinder members (12, 14) about said first and second axes, commutating valve means for establishing fluid flow into said closed pumping chamber (16) during one portion of each revolution to charge said chamber (16) and for establishing fluid flow from said pumping chamber (16) during the remainder of each revolution, said commutating valve means including a fluid passage extending from said pumping chamber (16) to a single radial port (48) rotatable about one of said first and second axes and first and second fixed ports (50, 52) spaced circumferentially from one another for independent fluid communication with said radial port (48) during the rotation thereof, whereby fluid flows into said radial port (48) from one of said fixed ports (50, 52) and out of said radial port (48) and into the other of said fixed ports (50, 52).

2. A pump assembly as set forth in claim 1 further characterized by said support means including first and second stationary housing members (20, 24) with said first housing member (20) defining said first axis (22) and said second housing (24) member defining said second axis (26) and adjustment means including a pivot connection (36) between said housing members (20, 24) for selectively allowing said housing members (20, 24) to pivot relative to one another about a pivot axis defined by said pivot connection (36) for varying said distance between said first and second axes (22, 26).

3. A pump assembly as set forth in claim 2 further characterized by said pivot connection (36) being spaced equally from said first and second axes (22, 26) so that said first and second axes (20, 26) may be moved toward and away from one another along the circumference of a circle having its center at said pivot connection (36).

4. A pump assembly as set forth in claim 3 further characterized by said adjustment means including securing means (34, 38) connecting said housing members (20, 24) together for preventing relative movement therebetween about said pivot connection (36) and for allowing the position of said first and second axes (22, 26) to be adjusted between a first maximum displacement position with one (26) of said axes disposed the maximum distance from the other axis (22) along said circumference of said circle and a zero displacement position with said first and second axes (22, 26) being disposed zero distance apart at a point on said circumference for zero fluid flow between said first and second fixed parts (50, 52).

5. A pump assembly as set forth in claim 4 further characterized by including a drive means (22) supported by one (20) of said housing members for rotating one of said piston and said cylinder members (12, 14).

6. A pump assembly as set forth in claim 4 further characterized by including drive means (22) rotatably supported by one (20) of said housing members and supporting one (12) of said piston and said cylinder members, and the other (24) of said housing members rotatably supporting the other (14) of said piston and said cylinder members and including said first and second fixed ports (50, 52) therein.

7. A pump assembly (10) comprising: piston and cylinder pumping members (12, 14) in telescoping relationship with one another for reciprocating movement relative to one another along a reciprocating axis to define a single pumping chamber (16) therebetween; piston support means (20, 22, 30, 32) supporting said piston member (12) for rotation about a first axis extending transversely to said reciprocating axis; cylinder support means (24) supporting said cylinder member (14) for rotation about a second axis extending transversely to said reciprocating axis so that said piston member (12) rotates about said first axis in conjunction with said cylinder member (14) rotating about said second axis, said cylinder member (14) being open to receive and enclose said piston member (12) to establish one pumping chamber (16) between said piston and cylinder members (12, 14); said cylinder member (14) closing said pumping chamber (16) at all positions of relative reciprocation and of rotation of said piston and cylinder members (12, 14) about said first and second axes; commutating valve means for establishing fluid flow into said closed pumping chamber (16) during one portion of each revolution to charge said chamber (16) and for establishing fluid flow from said pumping chamber (16) during the remainder of each revolution; said piston support means (20) including a first housing member (20), a circular wheel (30) rotatably supported by said first housing member (20) for rotation about said first axis (22), and a pin (32) interconnecting said wheel (30) and said piston member (12) on a swinging axis radially spaced from said first axis for allowing said reciprocating axis of said piston member (12) to swing about said swinging axis of said pin (32), said swinging axis (32) and said first and second axes (20, 26) all being parallel to one another; said cylinder support means including a second housing member (24), a support shaft (26) supporting said cylinder member (14) and rotatably supported by said second housing member (24) for rotation about said second axis (26); a fluid passage extending from said pumping chamber (16) through said support shaft (26) to a single radial port (48) in said support shaft, said second housing member (24) having first and second fixed ports (50, 52) spaced circumferentially from one another about said support shaft (26) and axially aligned with said radial port (48) for fluid communication therewith during rotation of said support shaft (26); adjustment means including a pivot connection (36) between said housing members (20, 24) for selectively allowing said housing members (20, 24) to pivot relative to one another about a pivot axis (36) which is parallel to said first and second axes (22, 26) for adjusting the distance between said first and second axes (22, 26), said pivot axis (36) of said pivot connection being equally spaced from said first and second axes (22, 26) so that said first and second axes (22, 26) may be moved toward and away from one another along the circumference of a circle having its center on said pivot axis (36) of said pivot connection, and securing means (34, 38) connecting said housing members (20, 24) together for preventing relative movement therebetween about said pivot axis (36) of said pivot connection and for allowing the position of said second axis of said support shaft (26) to be adjusted along said circumference to adjust said length of said relative reciprocating movement.

8. A pump assembly (10) comprising: piston and cylinder pumping members (12, 14) on telescoping relationship with one another for reciprocating movement relative to one another along a reciprocating axis to define a single pumping chamber (16) therebetween; piston support means (20, 22, 30, 32) supporting said piston member (12) for rotation about a first axis extending transversely to said reciprocating axis; cylinder support means (24) supporting said cylinder member (14) for rotation about a second axis extending transversely to said reciprocating axis so that said piston member (12) rotates about said first axis in conjunction with said cylinder member (14) rotating about said second axis; said cylinder member (14) being open only to receive said piston member (12) to establish only one enclosed pumping chamber (16) between said piston and cylinder members (12, 14); commutating valve means for establishing fluid flow into said single pumping chamber (16) during one portion of each revolution to charge said chamber (16) and for establishing fluid flow from said pumping chamber (16) during the remainder of each revolution; said piston support means (20) including a first housing member (20), a circular wheel (30) rotatably supported by said first housing member (20) for rotation about said first axis (22), and a pin (32) interconnecting said wheel (30) and said piston member (12) on a swinging axis radially spaced from said first axis for allowing said reciprocating axis of said piston member (12) to swing about said swinging axis of said pin, (32) said swinging axis (32) and said first and second axes (20, 26) all being parallel to one another; said cylinder support means including a second housing member (24), a support shaft (26) supporting said cylinder member (14) and rotatably supported by said second housing member (24) for rotation about said second axis (26); a fluid passage extending from said pumping chamber (16) through said support shaft (26) to a radial port (48) in said support shaft, said second housing member (24) having first and second fixed ports (50, 52) spaced circumferentially from one another about said support shaft (26) and axially aligned with said radial port (48) for fluid communication therewith during rotation of said support shaft (26); adjustment means including a pivot connection (36) between said housing members (20, 24) for selectively allowing said housing members (20, 24) to pivot relative to one another about a pivot axis (36) which is parallel to said first and second axes (22, 26) for adjusting the distance between said first and second axes (22, 26), said pivot axis (36) of said pivot connection being equally spaced from said first and second axes (22, 26) so that said first and second axes (22, 26) may be moved toward and away from one another along the circumference of a circle having its center on said pivot axis (36) of said pivot connection, and securing means (34, 38) connecting said housing members (20, 24) together for preventing relative movement therebetween about said pivot axis (36) of said pivot connection and for allowing the position of said second axis of said support shaft (26) to be adjusted along said circumference to adjust said length of said relative reciprocating movement, said second housing member (24) including a cavity (58) disposed at the end of said support shaft (26) for fluid communication with a reservoir and including a check valve (62, 64, 66) in the end of said support shaft (26) for establishing fluid communication between said cavity (58) and said fluid passage in said support shaft (26) to replenish fluid to said pumping chamber (16).

9. A pump assembly as set forth in claim 8 wherein said securing means includes vernier positioning means (40, 42, 44, 46) for adjusting said distance between said first, and second axes (22, 26).

10. A pump assembly as set forth in claim 9 further characterized by said vernier positioning means including a threaded bore extending into said second housing member (24) and a threaded screw (40) disposed therein; and said securing means includes a bolt (34) extending transversely through said bore from said first housing member (20) for selectively clamping said housing members (20, 24) together, said threaded screw (40) abutting the side of said bolt (34) for reacting thereagainst, said second housing member (24) having an elongated slot (42) through which said bolt (34) extends, and biasing means (44, 46) reacting between said second housing member (24) and said bolt (34) for urging said bolt (34) against said threaded screw (40).

11. A pump assembly as set forth in claim 10 further characterized as said piston member (12) including a fluid passage (54) therein communicating between said fluid passage in said support shaft (26) and said pumping chamber (16).

12. A pump assembly (10) comprising: piston and cylinder pumping members (12, 14) in telescoping relationship with one another for reciprocating movement relative to one another along a reciprocating axis to define a pumping chamber (16) therebetween, piston support means (20, 22, 30, 32) supporting said piston member (12) for rotation about a first axis extending transversely to said reciprocating axis, cylinder support means (24) supporting said cylinder member (14) for rotation about a second axis extending transversely to said reciprocating axis so that said piston member (12) rotates about said first axis in conjunction with said cylinder member (14) rotating about said second axis, said cylinder member (14) being open to receive and enclose said piston member (12) to close said pumping chamber (16) at all positions of relative reciprocation and of rotation of said piston and cylinder members (12, 14) about said first and second axes, a fluid passage extending from said pumping chamber (16) between said piston member (12) and said cylinder member (14) to a single radial port (48) rotatable about one of said first and second axes and first and second fixed ports (50, 52) non-rotatable about said one axis and spaced circumferentially from one another and axially aligned with said radial port for alternately communicating with said radial port (48) for establishing fluid flow from said first fixed port (50) through said radial port (48) to said pumping chamber (16) and from said pumping chamber (16) through said radial port (48) to said second fixed port (52) upon rotation in one direction about said first and second axes and for establishing fluid flow from said second fixed port (52) through said radial port (48) to said pumping chamber (16) and from said pumping chamber (16) through said radial port (48) to said first fixed port (50) upon rotation in the opposite direction about said first and second axes.

13. A pump assembly as set forth in claim 12 further characterized by including drive means (22) rotatably supported by one (20) of said housing members and supporting one (12) of said piston and said cylinder members, and the other (24) of said housing members rotatably supporting the other (14) of said piston and said cylinder members and including said first and second fixed ports (50, 52) therein.

14. A pump assembly as set forth in claim 13 further characterized by said piston support means including a wheel (30) being diametrically balanced across said first axis and said cylinder (14) being diametrically balanced across said second axis.

* * * * *